US008152460B2

(12) United States Patent
Brunet et al.

(10) Patent No.: US 8,152,460 B2
(45) Date of Patent: Apr. 10, 2012

(54) DEVICE FOR BLEEDING AIR FROM A TURBOMACHINE COMPRESSOR

(75) Inventors: Antoine Robert Alain Brunet, Moissy Cramayel (FR); Laurent Jablonski, Melun (FR); Sebastien Juste, Saint Fargeau Ponthierry (FR); Julien Sedlak, Paris (FR)

(73) Assignee: SNECMA, Paris (FR)

( * ) Notice: Subject to any disclaimer, the term of this patent is extended or adjusted under 35 U.S.C. 154(b) by 612 days.

(21) Appl. No.: 12/332,685

(22) Filed: Dec. 11, 2008

(65) Prior Publication Data

US 2009/0155056 A1 Jun. 18, 2009

(30) Foreign Application Priority Data

Dec. 14, 2007 (FR) ..... 07 08702

(51) Int. Cl.
*F04D 27/02* (2006.01)
*F04D 29/46* (2006.01)
*F01B 25/02* (2006.01)

(52) U.S. Cl. ..... 415/201; 415/144; 415/145

(58) Field of Classification Search ..... 60/782, 60/785; 415/118, 201, 121.2, 144, 145
See application file for complete search history.

(56) References Cited

U.S. PATENT DOCUMENTS

| | | | | |
|---|---|---|---|---|
| 3,597,106 | A * | 8/1971 | Anderson | 415/144 |
| 3,905,191 | A * | 9/1975 | Matto | 60/785 |
| 3,936,217 | A * | 2/1976 | Travaglini et al. | 415/118 |
| 3,945,759 | A * | 3/1976 | Bobo | 415/145 |
| 3,976,394 | A * | 8/1976 | Tarter et al. | 415/144 |
| 4,406,580 | A * | 9/1983 | Baran, Jr. | 415/118 |
| 4,844,689 | A * | 7/1989 | Seed | 415/169.1 |
| 5,203,162 | A * | 4/1993 | Burge | 60/785 |
| 5,351,478 | A * | 10/1994 | Walker et al. | 60/785 |
| 5,380,151 | A | 1/1995 | Kostka et al. | |
| 6,048,171 | A * | 4/2000 | Donnelly et al. | 415/145 |
| 6,109,868 | A * | 8/2000 | Bulman et al. | 415/144 |
| 6,782,702 | B2 * | 8/2004 | Charon et al. | 60/785 |
| 7,249,929 | B2 * | 7/2007 | Cummings et al. | 415/144 |
| 2003/0223863 | A1 * | 12/2003 | Laurello et al. | 415/144 |
| 2005/0008476 | A1 | 1/2005 | Eleftheriou | |
| 2005/0089401 | A1 * | 4/2005 | Phipps | 415/178 |
| 2005/0097899 | A1 * | 5/2005 | Lepretre | 60/785 |

FOREIGN PATENT DOCUMENTS

| | | |
|---|---|---|
| EP | 0 374 004 A1 | 6/1990 |
| EP | 0 902 179 A2 | 3/1999 |
| EP | 1 531 236 A2 | 5/2005 |

OTHER PUBLICATIONS

Dial Type Torque Wrench Product Sheet, Aicraft Spurce, printed Jul. 6, 2011.*

* cited by examiner

*Primary Examiner* — Benjamin Sandvik
*Assistant Examiner* — Joseph Schoenholtz
(74) *Attorney, Agent, or Firm* — Oblon, Spivak, McClelland, Maier & Neustadt, L.L.P.

(57) ABSTRACT

A turbomachine compressor, including an air bleed device including a duct having a suction end opening out into an outer casing of the compressor level with a rotor wheel and a stator stage of the compressor is disclosed. A screen sheet of annular shape is mounted radially inside the casing facing a portion of the suction end of the duct so as to make the bleeding of air uniform over 360° around the axis of the compressor.

14 Claims, 4 Drawing Sheets

DEVICE FOR BLEEDING AIR FROM A TURBOMACHINE COMPRESSOR

FIELD OF THE INVENTION

The invention relates to a turbomachine compressor fitted with an air bleed system, and also to a turbomachine such as an airplane turboprop or turbojet that is fitted with a compressor of this type.

BACKGROUND OF THE INVENTION

A bypass turbomachine has an upstream air inlet that is divided into a primary air stream feeding compression and combustion stages, and a secondary air stream bypassing the turbojet and reuniting with the primary air stream at the outlet from the turbojet.

A fraction of the air passing through the compressor is bled off for various purposes, including pressurizing the cabin, deicing, or ventilating the turbine of the turbojet in order to cool it.

Air is generally bled from the high-pressure compressor, which has an outer casing for stiffening the compression stage and a wall defining the outside of the flow passage for the primary air stream inside the high-pressure compressor and formed by an arrangement of annular segments, some of which carry stator vanes and others of which, alternating with the preceding segments, extend at the radially outer ends of rotor wheels.

The outer casing includes an orifice having a suction duct mounted thereon, which duct opens out into an annular space made between an annular segment of a nozzle stage and an annular segment of a rotor wheel.

In operation, a fraction of the air flowing along the primary air passage of the high-pressure compressor is bled from the inter-segment space and is conveyed to the equipment that requires air under pressure via the suction duct that opens out into the outer casing.

Nevertheless, air is bled off maximally in register with the end of the suction duct, which leads to a drop in static pressure at that location. Large heterogeneities of static pressure are thus observed in the inter-segment space around the axis of the turbomachine, thereby decreasing the performance of the turbomachine. Those heterogeneities with increasing requirements for bleeding off air.

In certain critical situations, such as an engine breakdown, the engine that remains in operation must be capable of delivering all of the bled-off air. For example, in normal operation, the maximum amount of air bled off represents about 8% of the mean flow through the compressor, and in the event of an engine breaking down, the other engine then needs to be capable of delivering up to 16% of its mean flow, which can be impossible if static pressure is highly non-uniform around the axis of the compressor.

Increasing the number of suction ducts around the outer casing is a solution that cannot be envisaged since that would complicate the pipework for delivering air under pressure and would increase the weight of the turbomachine.

OBJECT AND SUMMARY OF THE INVENTION

A particular object of the invention is to limit variations in static pressure around the axis of the turbomachine while conserving the same capacity for bleeding air from the high-pressure compressor.

To this end, the invention provides a turbomachine compressor, such as a high-pressure compressor, including air bleed means comprising a duct having a suction end opening out into an outer casing of the compressor level with a rotor wheel and a stator stage of the compressor, wherein a screen sheet of annular shape is mounted radially inside the casing facing a portion of the suction end of the duct so as to make the bleeding of air uniform over 360° around the axis of the compressor.

The use of such a screen sheet, a portion of which partially covers the end of the suction duct, serves to limit the amount of air that is bled from this location, thereby avoiding a significant drop in static pressure at this location. To do this, the amount of air that is bled from portions of the air flow passage that are angularly further away from the end of the suction duct is increased. The sheet thus serves to spread the bleeding of air from the compressor air-flow passage over 360°, thereby limiting angular heterogeneities in static pressure and improving the performance of the turbomachine.

According to another characteristic of the invention, the screen sheet includes bearing means at its upstream end for bearing radially against a flange of the casing, the downstream end of the sheet being fastened by screws to an annular flange of the stator stage mounted downstream from the rotor wheel.

The screen sheet is thus mounted on pre-existing mechanical parts, so incorporating it in the environment of the high-pressure compressor does not require any structural modification thereto.

Advantageously, the bearing means comprise rims of cylindrical shape extending upstream.

The screen sheet preferably extends over less than 360° and includes a cylindrical rim at each of its circumferential ends. It can thus bear against the flange of the casing solely at its circumferential ends, and the air stream can flow between the flange and the upstream end of the sheet. Limiting the circumferential extent of the sheet serves to conserve a mean static pressure around the axis of the compressor that is similar to that in the prior art, thereby avoiding any need to have recourse to other sources for bleeding air, which would increase fuel consumption.

In an embodiment of the invention, the screen sheet extends over about 234° and its cylindrical end rims extend angularly over several tens of degrees.

The downstream end of the screen sheet may include holes of larger diameter disposed alternately with holes of smaller diameter for passing fastener screws.

Thus, the screen sheet is fastened to the annular flange of the downstream stator vanes stage only via screws inserted in the smaller-diameter holes and clamped against the flange. The larger-diameter holes serve solely for passing the heads of the screws for fastening the flange of the downstream stator stage to a flange of the following downstream stator stage. The screen sheet does not contribute to providing the compressor stage with mechanical strength, so there is no need for it to be fastened to the flange of the downstream stator stage with a large number of fastener screws.

The screen sheet may be mounted with resilient prestress to bear against the flange of the casing via the upstream end of the screen sheet.

The stator stage situated upstream from the rotor wheel is fastened to the casing flange via a shroud that including holes for passing air, with those holes that are situated level with a central portion of the screen sheet being closed completely, whereas those that are situated facing the end portions of the screen sheet are closed to 50%.

Closing the holes in the shroud completely or partially serves to bleed air with a better distribution around the axis of the turbomachine.

The screen sheet also includes at least one orifice for passing an endoscope for use in verifying the state of the parts of the compressor that are situated radially inside the screen sheet.

The invention also provides a screen sheet of annular shape for use in a compressor of the above-described type, wherein its section is L-shaped and wherein it comprises a cylindrical wall connected at one end to a radial wall including holes for passing fastener screws, its other end being connected to a frustoconical wall.

According to another characteristic, the frustoconical wall of the screen sheet includes radial rims extending outwards from its circumferential ends.

The invention also provides a turbomachine such as an airplane turboprop or turbojet, including a compressor of the above-described type.

BRIEF DESCRIPTION OF THE DRAWINGS

The invention can be better understood and other details, advantages, and characteristics of the invention appear on reading the following description made by way of non-limiting example and with reference to the accompanying drawings, in which.

MORE DETAILED DESCRIPTION

Figure 1:
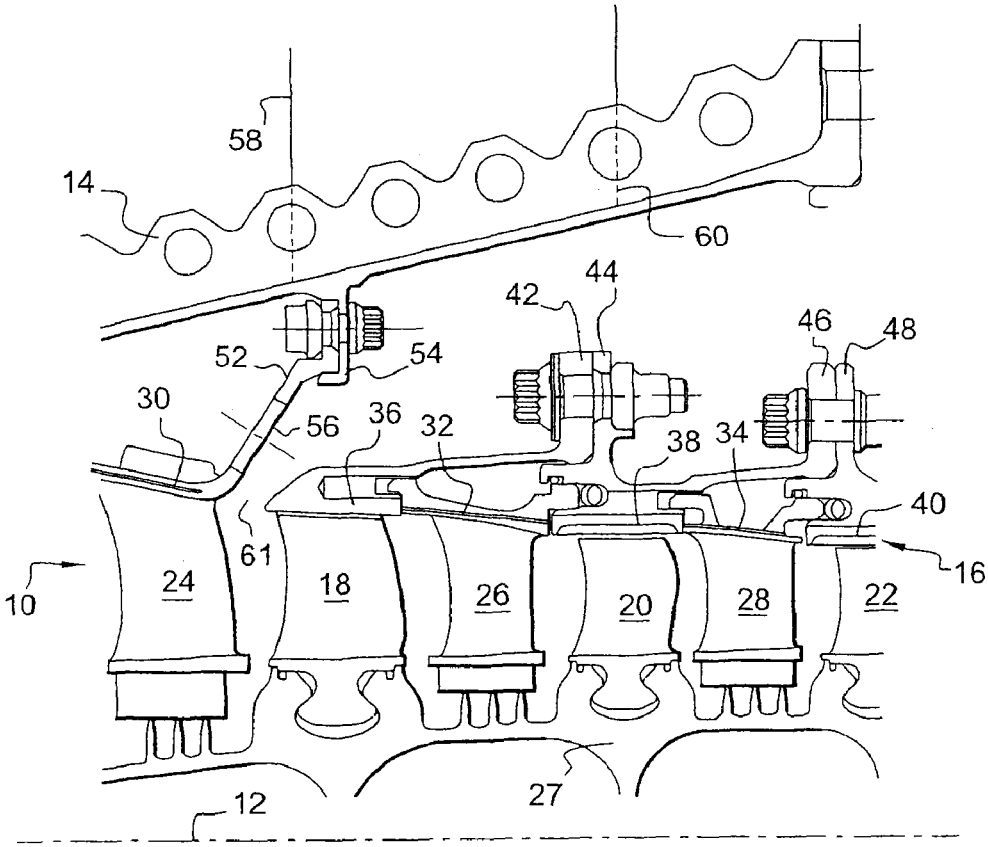
Fig. 1 BACKGROUND ART
FIG. 1 is a diagrammatic axial section view of a portion of a high-pressure compressor of a turbomachine including a prior art air bleed device.

Reference is made initially to FIG. 1 that shows the downstream portion of a high-pressure compressor 10 of axis 12 mounted downstream from a low-pressure compressor and upstream from a combustion chamber. The high-pressure compressor 10 comprises an outer casing 14 and a wall 16 in which there revolve a plurality of rotor wheels 18, 20, 22 disposed to alternate with stator stages 24, 26, 28. The wall 16 comprises a series of annular segments, some of which 30, 32, 34 carry the radially outer ends of the stator vanes 24, 26, 28 and others of which 36, 38, 40, placed to alternate with the preceding segments, face the radially outer ends of the rotor wheels 18, 20, 22 carried by a rotary shaft 27. The annular segments are interconnected by means of annular flanges 42, 44, 46, 48 and they are connected as a whole to the outer casing 14.

An air bleed is provided between a nozzle stage 24 and a downstream rotor wheel 18 by axial spacing between the downstream end of the segment 30 of the upstream stator stage 24 and the upstream end of the segment 36 placed facing the rotor wheel 18. The segment 30 of the upstream nozzle stage 24 is connected to the outer casing 14 by a shroud 52 extending upstream and fastened at its radially outer end to an inner flange 54 of the casing 14. The shroud 52 includes a multitude of air-passing holes 56 distributed around its circumference. The air bleed means in the compressor 10 include a duct 58 having a suction end mounted on an orifice 60 of the outer casing 14. This orifice 60 is axially positioned on the outer casing 14 in such a manner as to be situated facing the inter-segment space 61. Its diameter is such that it opens out on either side of the fastener shroud 52 of the upstream stator stage 24.

In operation, the stream of air entering into the turbomachine is split into two portions, one of which corresponds to a primary air stream that passes through the high-pressure compressor 10. A fraction of the air passing therealong escapes via the inter-segment space 61 and passes on either side of the upstream shroud 52 through holes 56 so as to be sucked into the duct 58 enabling air under pressure to be taken to equipment that requires it.

Figure 2:
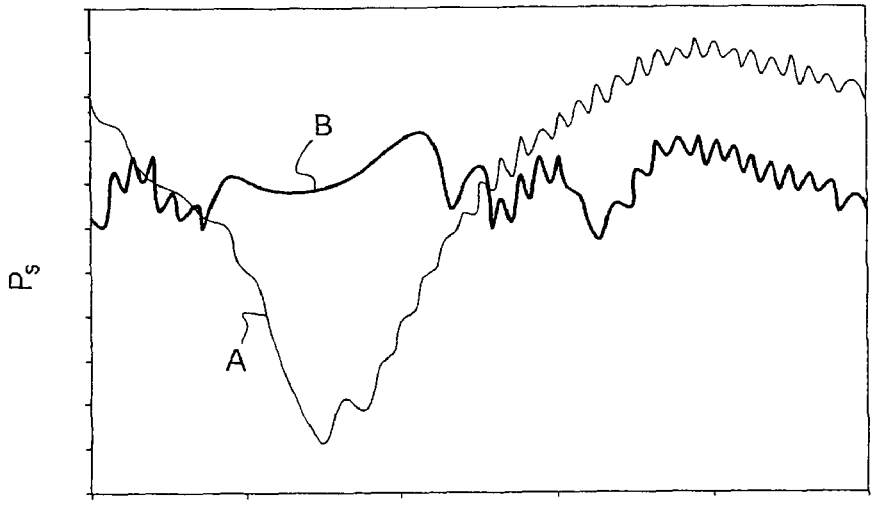
FIG. 2 is a graph showing variations in static pressure as a function of angular position about the axis of the turbomachine.

FIG. 2 plots a curve A showing variations in static pressure measured level with the inter-segment space 61 as a function of angular position around the axis 12 of the compressor 10, for an air bleed device as described above. Zero on the abscissa axis represents the vertical direction, with increasing angle taking place clockwise relative to the compressor when seen from behind, with the hole 60 of the suction duct 68 being centered at 114°.

In this graph, it can be seen that there is a static pressure minimum of about 2.45 arbitrary units (a.u.) that occurs at an angular position of about 114°, corresponding to the position of the suction duct 58. Static pressure increases on going away from the suction duct 58 and the maximum static pressure reached is of the order of 2.9 a.u.

This graph shows that air is bled for the most part in the immediate vicinity of and in register with the suction hole 60, which leads to large variations in static pressure around the axis 12 of the high-pressure compressor 10.

Figure 3:
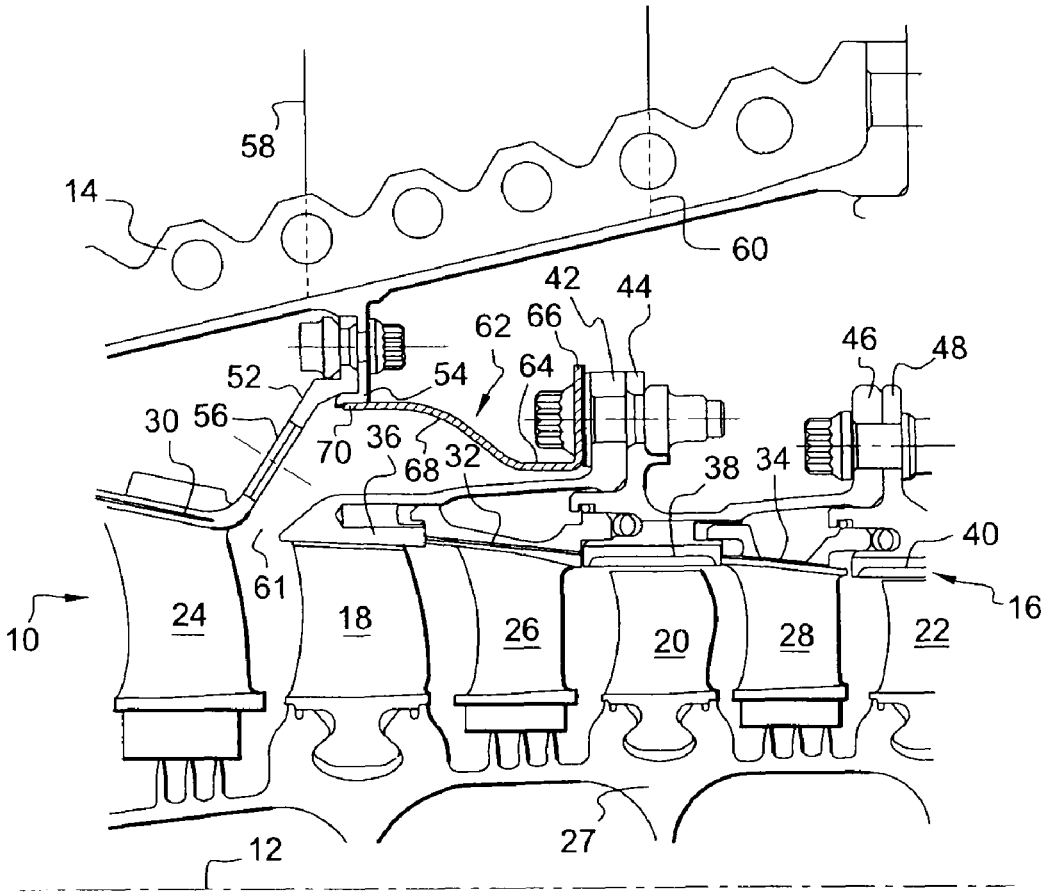
FIG. 3 is a diagrammatic axial section view of a portion of a turbomachine high-pressure compressor including a screen sheet of the invention.
Figure 4:
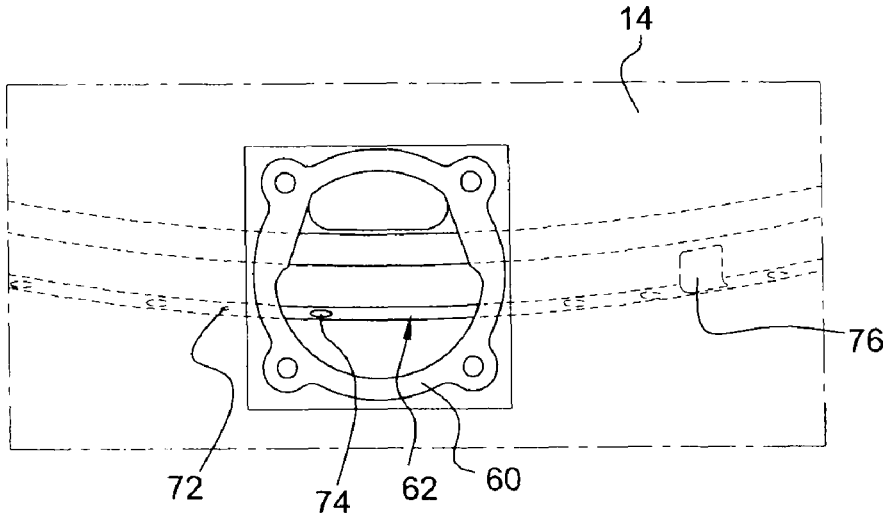
FIG. 4 is a diagrammatic plan view of a portion of the screen sheet mounted in register with an air suction hole formed in the outer casing.

The invention enables this problem to be solved and also the problems mentioned above by mounting a sheet 62 of annular shape inside the outer casing 14 so as to form a screen facing a portion of the suction end of the duct 58 so as to make air bleed uniform over 360° around the axis 12 of the high-pressure compressor 10 (FIGS. 3 and 4).

The screen sheet 62 extends over less than 360° and presents an axial section that is L-shaped. It comprises a cylindrical wall 64 connected at its downstream end to a radial wall 66, its upstream end being connected to a frustoconical wall 68 of section that flares upstream.

Figure 5:
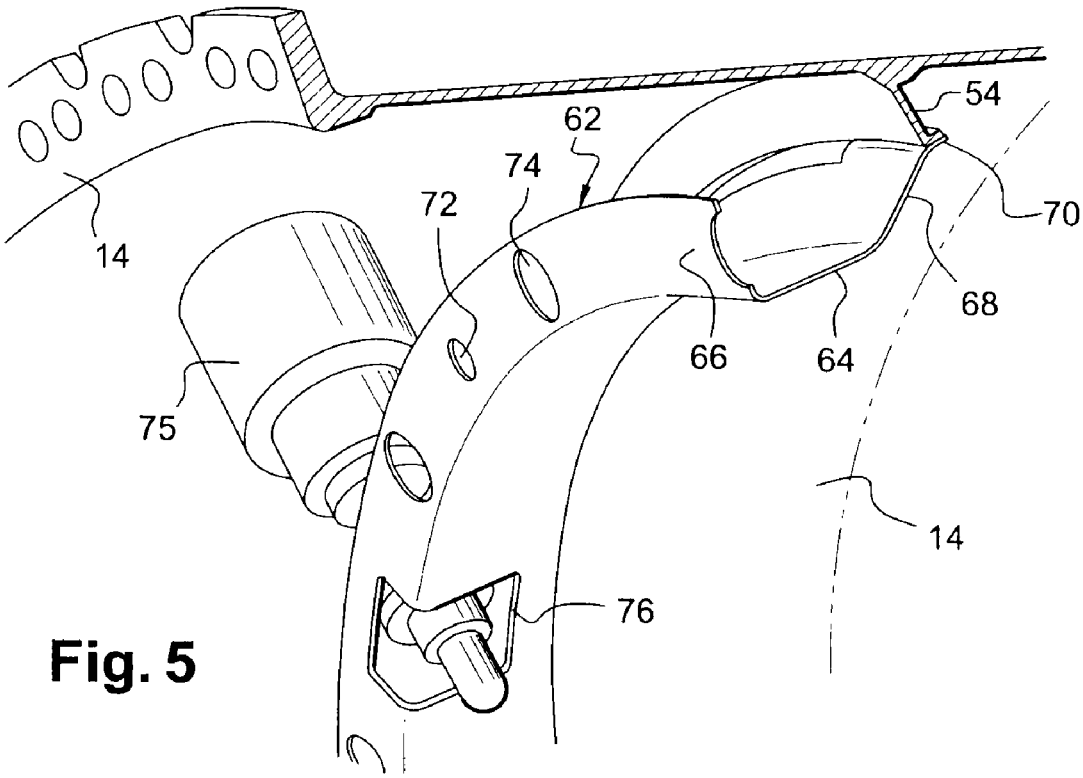
FIG. 5 is a diagrammatic perspective view of an endoscope mounted on the outer casing and inserted in an orifice in the screen sheet of the invention.

The upstream end of the frustoconical wall 68 has bearing means for bearing radially on the fastener flange 54 of the shroud 52 of the upstream stator stage 24 (FIGS. 3 and 5). These means comprise rims 70 of cylindrical shape extending upstream. The rims 70 are formed at each of the circumferential ends of the sheet 62 and they extend angularly over several tens of degrees.

The radial wall 66 is fastened to the annular fastener flanges 42 and 44 of the annular segments 36 and 38. It includes small diameter holes 72 alternating with holes 74 of larger diameter. The small diameter holes 72 allow fastener screws to be passed through and the heads of the screws to be clamped against the radial wall 66. The larger diameter holes 74 are of diameter that is sufficiently large to allow the heads of those same screws to pass through. These holes 74 are not used for clamping the radial wall 66.

The holes 56 in the fastener shroud 52 of the upstream nozzle stage 24 that are situated in the central portion of the screen sheet 62 are completely covered, while the holes 56 situated facing the end portions 70 of the screen sheet 66 are covered to 50% only.

When the turbomachine is in operation (FIG. 8), a fraction of the air flowing in the compressed air passage escapes through the inter-segment space 61.

In register with the suction duct, the air bled from the compressor 10 flows between the radially inner end of the fastener flange 54 of the upstream stator stage 24 and the upstream end of the frustoconical wall 68 of the screen sheet 62 (arrow F1). The small space between the flange 54 and the upstream end of the sheet 62 and the total closure of the holes 56 through the upstream shroud 52 in the central portion of the sheet 62 serves to limit the amount of air that is bled off in register with the duct 58, thereby avoiding the drop in static pressure at this location (curve B in FIG. 2).

Arrow F2 represents the air stream coming from the compressor 10 and passing through the uncovered or partially covered holes 56 in the shroud 52 of the upstream stator stage 24 that are situated close to the circumferential end 70 of the sheet 62.

Beyond the circumferential ends 70 of the sheet 62, the air bled from the high-pressure compressor 10 passes between the sheet 62 and the outer casing 14 so as to be subsequently sucked into the duct 58 (arrows F3).

Thus, the way air is bled from the high-pressure compressor 10 is distributed uniformly over 360° around the axis 12 of the compressor 10. As shown by curve B in FIG. 2, the static pressure varies little around a mean value as a function of angular position, thereby making it possible to greatly reduce heterogeneities in static pressure around the axis 12 of the compressor 10.

In addition, using this sheet does not decrease the capacity of the duct to bleed air since the mean static pressure both with and without the screen sheet 62 are substantially similar and about 2.75 a.u.

The screen sheet 62 may be mounted at its upstream end with resilient prestress to bear against the flange of the outer casing, thereby guaranteeing continuous contact of the sheet against the flange. In operation, the air sucked into the duct 58 serves to press the upstream end of the sheet harder against the flange 54 of the casing 14.

Figure 6:
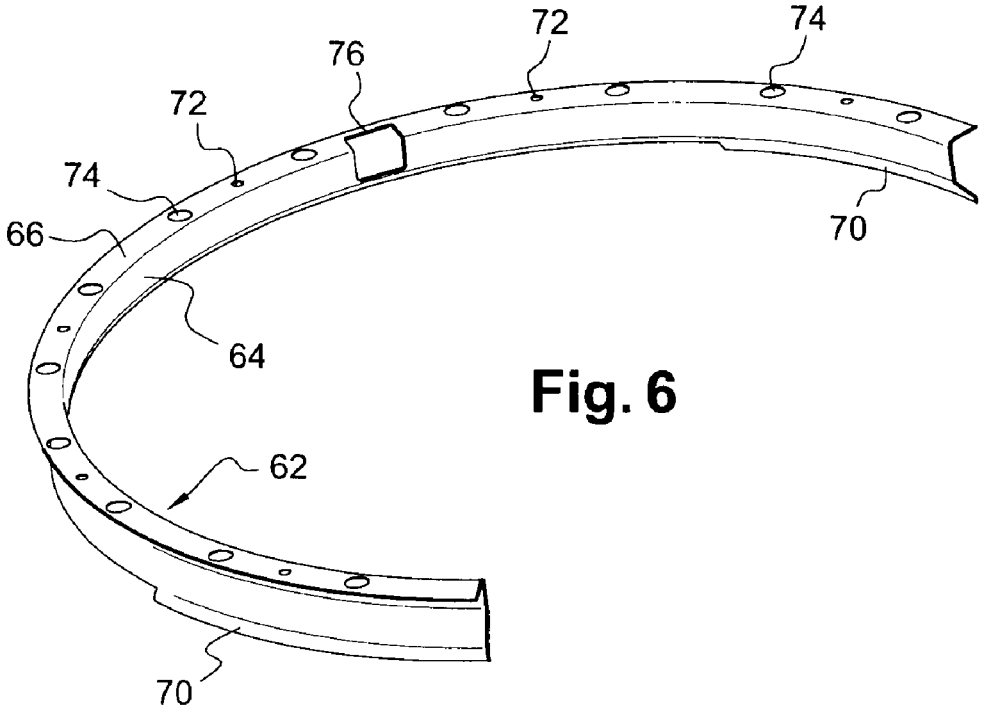
FIG. 6 is a diagrammatic perspective view of a screen sheet of the invention.
Figure 7:
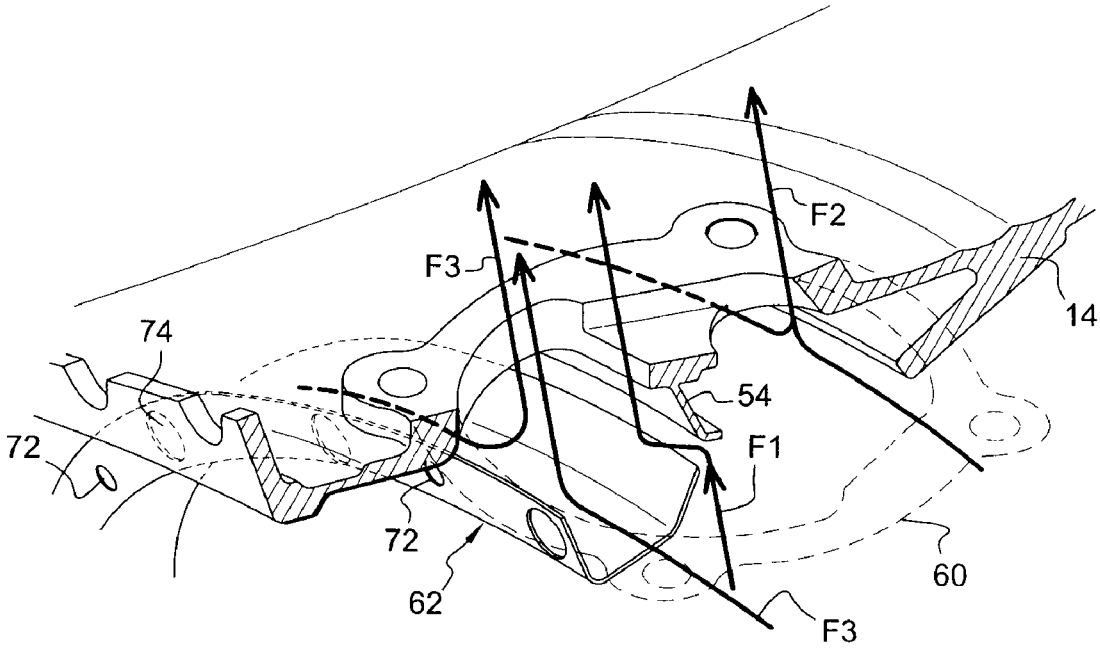
FIG. 7 is a diagrammatic perspective view partially in section showing an air bleed hole in the outer casing and the screen sheet of the invention.

A compressor casing usually includes one or more orifices for passing an endoscope 75 for investigating the inside of the compressor. For this purpose, and as shown in FIGS. 5 and 6, the sheet 62 may include at least one orifice 76 for passing such an endoscope.

The screen sheet extends over at least 180° and at most over about 270°, approximately.

In a practical embodiment of the invention, the screen sheet extends over 234° and has a cylindrical rim 70 extending between 0° to 36°, with its other rim extending between 180° and 234°. The axial size of the sheet is 36.3 millimeters (mm) and its circumferential end and 30 mm elsewhere. The thickness of the sheet is about 1 mm.

The sheet 62 may include in its middle portion and at its upstream end a rim that projects upstream and that is of axial size that is smaller than the cylindrical rims of the circumferential ends 70. The function of this rim is to stiffen the sheet and thus raise the frequencies of its natural modes of vibration so as to avoid any phenomenon of screen sheet resonance when it is subjected to vibration as air flows past it while the turbomachine is in operation. By way of example, the axial size of this rim may be 2 mm.

Incorporating the screen sheet 62 of the invention between the outer casing 14 and the wall 16 does not require any structural modification to the compressor 10 since this sheet comes to bear at one end against a flange 54 that is used for fastening the upstream shroud 52 and is fastened to the flanges 42 and 44 for fastening the segments 36 and 38. This sheet 62 can thus be mounted in any turbomachine during manufacture or during a maintenance operation.

Figure 8:
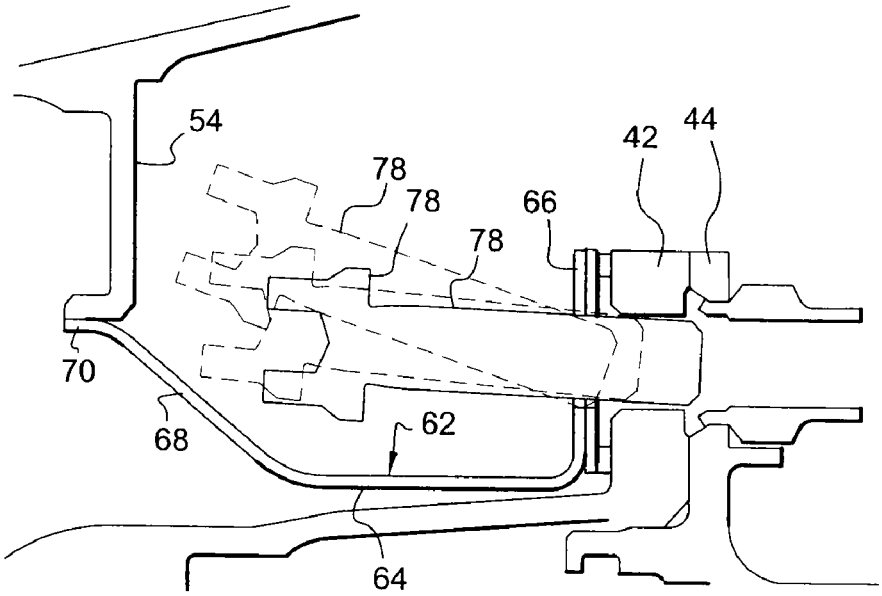
FIG. 8 is a diagrammatic view on a larger scale showing the mounting of screen sheet fastener screws in an annular flange of a stator stage.

FIG. 8 shows how fastener screws 78 are mounted in the holes 72 of the screen sheet 62. The presence of a frustoconical wall 68 at the upstream end of the cylindrical wall 62 enables the screws 78 to be inserted without difficulty in the holes in the flange 42.

What is claimed is:

1. A compressor, including air bleed means comprising a duct having a suction end opening out into an outer casing of the compressor level with a rotor wheel and a stator stage arranged coaxially with the compressor, wherein a screen sheet of annular shape is mounted radially inside the outer casing facing a portion of the suction end of the duct, and wherein the screen sheet extends over less than 360° and includes circumferential ends each having a rim of cylindrical shape, the rims bearing radially against a flange of the outer casing and defining an annular space between them and between the screen sheet and the flange.

2. A compressor according to claim 1, wherein the sheet has a downstream end fastened by screws to an annular flange of the stator stage mounted downstream from the rotor wheel.

3. A compressor according to claim 2, wherein the screen sheet extends over about 234° and the cylindrical rims at the circumferential ends of the screen sheet extend angularly over several tens of degrees.

4. A compressor according to claim 2, wherein the downstream end of the screen sheet includes holes of larger diameter disposed alternately with holes of smaller diameter for passing fastener screws.

5. A compressor according to claim 2, wherein the screen sheet is mounted with resilient prestress to bear against the flange of the casing.

6. A compressor according to claim 2, wherein a stator stage situated upstream from the rotor wheel is fastened to the flange of the casing by a shroud that includes holes, with those that are angularly situated level with the suction end of the duct and a central portion of the screen sheet being totally covered.

7. A compressor according to claim 6, wherein the holes in the shroud facing axially the circumferential end portions of the screen sheet are 50% covered.

8. A compressor according to claim 1, wherein the screen sheet includes at least one orifice for passing an endoscope.

9. A screen sheet of annular shape for use in a compressor according to claim 1, wherein the screen sheet section is L-shaped.

10. A screen sheet according to claim 9, comprising a cylindrical wall connected at a first end to a radial wall having holes for passing fastener screws and connected at a second end to a frustoconical wall.

11. A screen sheet according to claim 10, wherein the circumferential ends of the frustoconical wall includes radial rims facing outwards.

12. A turbomachine including a compressor according to claim 1.

13. A turbomachine according to claim 12, wherein the turbomachine is an airplane turboprop or a turbojet.

14. A compressor according to claim 1, wherein the cylindrical rims are provided on an upstream end of the screen sheet.

* * * * *